US009670638B2

(12) United States Patent
El Naggar et al.

(10) Patent No.: US 9,670,638 B2
(45) Date of Patent: Jun. 6, 2017

(54) SEISMIC RESTRAINT HELICAL PILE SYSTEMS AND METHOD AND APPARATUS FOR FORMING SAME

(71) Applicant: Hubbell Incorporated, Shelton, CT (US)

(72) Inventors: M. Hesham El Naggar, London (CA); Yasser Abdelghany, Victoria (CA); Mahmoud M. El Sharnouby, London (CA); Roy Frater, Waterloo (CA)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/936,191

(22) Filed: Nov. 9, 2015

(65) Prior Publication Data

US 2016/0060838 A1 Mar. 3, 2016

Related U.S. Application Data

(63) Continuation of application No. 13/169,543, filed on Jun. 27, 2011, now Pat. No. 9,181,674.

(51) Int. Cl.

| | |
|---|---|
| ***E02D 5/52*** | (2006.01) |
| ***E02D 5/56*** | (2006.01) |
| ***E02D 5/60*** | (2006.01) |
| ***E02D 5/62*** | (2006.01) |
| ***E02D 5/36*** | (2006.01) |
| ***E02D 7/22*** | (2006.01) |
| ***E02D 27/12*** | (2006.01) |
| ***E02D 27/50*** | (2006.01) |

(52) U.S. Cl.

CPC ..... *E02D 5/36* (2013.01); *E02D 5/526* (2013.01); *E02D 5/56* (2013.01); *E02D 7/22* (2013.01); *E02D 27/12* (2013.01); *E02D 27/50* (2013.01)

(58) Field of Classification Search

CPC E02D 5/52; E02D 5/523; E02D 5/526; E02D 5/56; E02D 5/60; E02D 7/22

USPC .... 405/231, 232, 249, 250, 251, 252.1, 257, 405/233; 403/286, 293, 305

See application file for complete search history.

(56) References Cited

U.S. PATENT DOCUMENTS

| | | | | |
|---|---|---|---|---|
| 3,326,006 A * | 6/1967 | Mount | ..... | E02D 5/52 285/381.1 |
| 6,264,402 B1 * | 7/2001 | Vickars | ..... | E02D 5/36 405/237 |
| 2005/0025577 A1 * | 2/2005 | Gagliano | ..... | E02D 27/14 405/239 |

OTHER PUBLICATIONS

Novotex Steel Fibre by Novocon, SI Corporation Inc., NVC-NVC-010, Published Apr. 2002, pp. 1-2.*

(Continued)

*Primary Examiner* — John Kreck
*Assistant Examiner* — Stacy Warren
(74) *Attorney, Agent, or Firm* — Michael Best & Friedrich LLP

(57) ABSTRACT

A reinforced helical pile system suitable for use in seismically active areas incorporates steel fibers in the grout and a fiber reinforced polymer sleeve (casing). A low-friction driving assembly and low-friction sleeve couplings enable the sleeve to be drawn into the soil substantially without rotation, reducing power consumption and preserving the integrity of the casing.

11 Claims, 5 Drawing Sheets

(56) References Cited

OTHER PUBLICATIONS

Series 3000A Fiberglass Pipe and Fittings, Bondstrand Product Data by Ameron International, FP516C published Oct. 2008, pp. 1-8.*
Harwall, http://harwal.com/products/teflonseals, website dated Nov. 23, 2010.*

* cited by examiner

SEISMIC RESTRAINT HELICAL PILE SYSTEMS AND METHOD AND APPARATUS FOR FORMING SAME

REFERENCE TO RELATED APPLICATION

This application is a continuation of co-pending, prior-filed U.S. patent application Ser. No. 13/169,543, filed Jun. 27, 2011, the entire contents of which are incorporated herein by reference.

TECHNICAL FIELD

The disclosure relates to deep foundation systems, and in particular to cased helical pile foundation systems.

BACKGROUND

Piles are used to support structures where surface soil is weak by penetrating the soil to a depth where a competent load-bearing stratum is found. Helical (screw) piles represent a cost-effective alternative to conventional piles because of their speed and ease of installation and relatively low cost. They have an added advantage with regard to their efficiency and reliability for underpinning and repair. A helical pile typically is made of relatively small galvanized steel shafts sequentially joined together, with a lead section having helical plates. It is installed by applying torque to the shaft at the pile head, which causes the plates to screw into the soil with minimal disruption.

The main drawbacks of helical piles are poor resistance to buckling and lateral movement. Greater pile stability can be achieved by incorporating a portland-cement-based grout column around the pile shaft. See, for example, U.S. Pat. No. 6,264,402 to Vickars (incorporated by reference herein in its entirety), which discloses both cased and uncased grouted screw piles and methods for installing them. The grout column is formed by attaching a soil displacement disk to the pile shaft, which creates a void as the shaft descends into which flowable grout is poured or pumped. The grout column may be reinforced with lengths of steel rebar and/or polypropylene fibers. A strengthening casing or sleeve (steel or PVC pipe) can also be installed around the grout column. However, because the casing segments are rotated as the screw and the shaft advance through the soil, substantial torque and energy are required to overcome frictional forces generated by contact with the surrounding soil and damage to the casing material can result. Further, cased and grouted helical piles installed using current techniques and materials cannot necessarily be relied on to maintain their integrity during and after a cyclic axial and lateral loading event, such as an earthquake.

SUMMARY

In one aspect, a method is provided for forming a cased helical pile that includes a screw pier including a first shaft having a screw near one end thereof followed axially by a radially outwardly projecting soil displacing member. The method comprises the steps of: placing the screw in soil and turning the first shaft to draw the screw into the soil; either before or after the preceding step, placing a cylindrical first sleeve around the first shaft with a first end thereof abutting the soil displacing member, and placing a driving assembly on the first shaft, the driving assembly having a low-friction drive seat that engages a second end of the first sleeve; operating the driving assembly to further turn the first shaft to draw the screw further into the soil, thereby causing the screw to pull the soil displacing member axially through the soil and to pull the first sleeve through the soil substantially without rotation thereof; and either during or after the immediately preceding step, filling the first sleeve with a hardenable fluid grout, thereby encasing the first shaft.

In order to form a deeper pile, the method further comprises adding shaft extensions and sleeve extensions one by one, preferably before the grout placement step. A cylindrical sleeve coupling, having two axially opposed low-friction seats, is placed between the ends of adjacent sleeve sections. As the shaft is turned to draw the screw further into the soil, the added extension sleeves are pulled through the soil substantially without rotating.

In another aspect, an apparatus for installing a cased helical pile includes a driving assembly having a rotatable head and a low-friction, axially facing annular drive seat surrounding a central opening that receives the pile shaft. The seat is adapted to abut an end of a sleeve and allow the head to rotate relative to the sleeve as the sleeve is drawn in to the soil. The apparatus also comprises at least one cylindrical sleeve coupling, each sleeve coupling adapted to surround the shaft and join a pair of adjacent sleeves. Each sleeve coupling comprises two axially opposed, low-friction, annular coupling seats, each of the coupling seats adapted to abut an end of one of a pair of adjacent sleeves and allow the sleeve coupling to rotate relative to the pair of adjacent sleeves.

In yet another aspect, an installed pile includes the following components integrated into the pile structure: a segmented shaft having a screw near a lower end thereof; a radially outwardly projecting soil displacing member on the shaft near the screw; a segmented casing including a plurality of serially arranged, cylindrical sleeves surrounding the shaft, the lowest one of the sleeves disposed adjacent the soil displacing member; at least one cylindrical sleeve coupling, each sleeve coupling surrounding the shaft and joining a pair of adjacent sleeves, each sleeve coupling including two axially opposed, low-friction, annular coupling seats, each of the coupling seats abutting an end of one of the pair of adjacent sleeves; and grout substantially filling the interior of said casing and encasing said shaft.

In still another aspect, an installed cased helical pile of the type described above includes cylindrical sleeves made of fiber-reinforced polymer, and grout reinforced with mixed-in steel fibers.

BRIEF DESCRIPTION OF THE DRAWINGS

Certain embodiments are described in detail below, purely by way of example, with reference to the accompanying drawing, in which.

DETAILED DESCRIPTION

Figure 1:
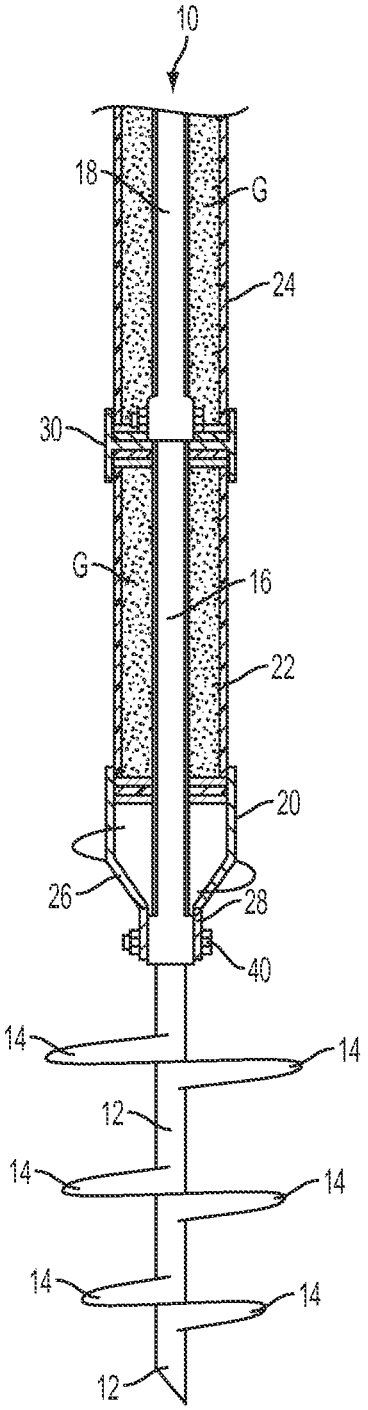
FIG. 1 is a schematic view in longitudinal section of the lower sections of a cased, grouted helical pile according to one embodiment.

Referring to FIG. 1, a helical pile has a central screw pier 10 including a series of conventional steel shaft sections with mating male and female ends that are bolted together sequentially as the pile is installed, in a manner well known in the art. The shaft cross-section preferably is square, but any polygonal cross-section or a round cross-section, or a combination of cross-sections, may be used. The bottom three shaft sections are shown in FIG. 1, it being understood that additional shaft sections are installed above those shown in like manner. A conventional lead shaft 12 at the lower end of the pile carries helical flights 14 that advance through the soil when rotated, pulling the pier downward. A first extension shaft 16 is joined to lead shaft 12 within a soil displacing coupling 20, a second extension shaft 18 is joined to first extension shaft 16, and so on to the top of the pile. Casing sleeve sections 22, 24, etc. surround the shaft sections 16, 18, etc. above soil displacing coupling 20, each pair of adjacent sleeves being joined by a sleeve coupling 30, which also functions as a centralizer for the shaft. Grout G completely fills the casing to encase the screw pier.

Figure 2:
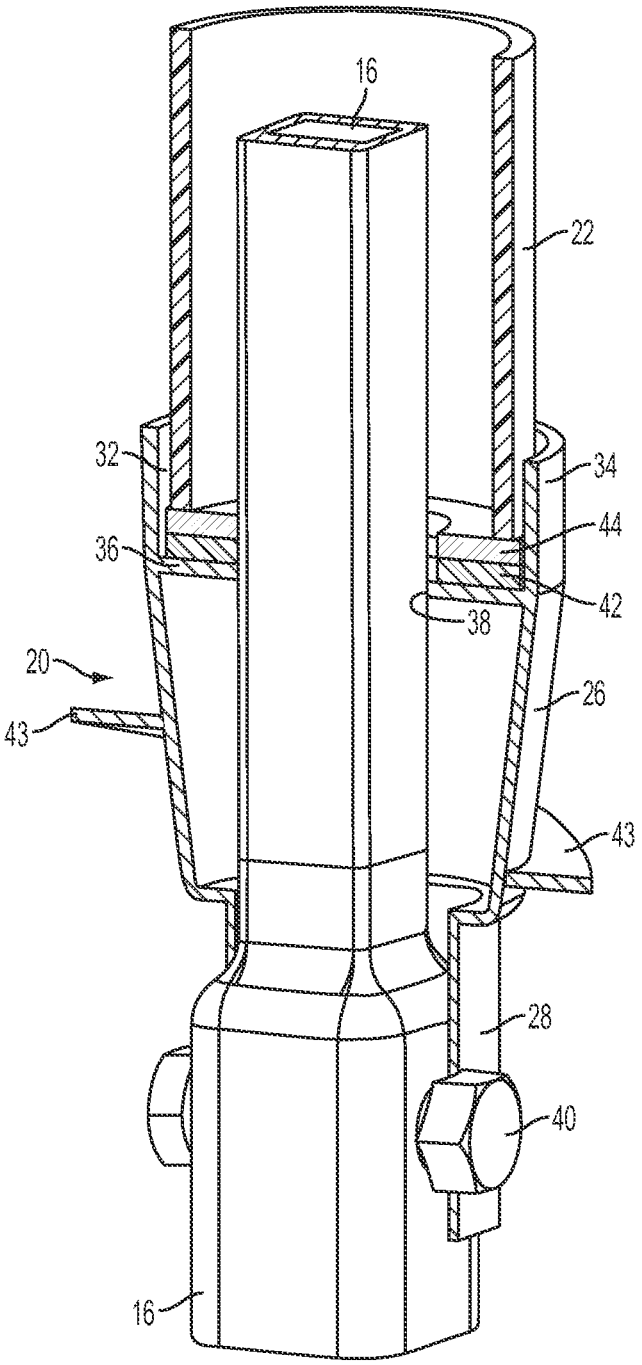
FIG. 2 is a perspective view in longitudinal section of a soil displacing coupling and pile shaft segment of the pile of FIG. 1.

Referring to FIG. 2, soil displacing coupling 20 is made of steel and comprises a tapered central body 26, a bottom square elevation tube 28 and a top cup-shaped recess 32 formed by a cylindrical wall 34 and an annular inner web 36, which has a square hole 38 for passage of and rotational engagement with extension shaft 16. A bolt 40 through elevation tube 28, extension shaft 16 and lead shaft 12 (not shown) secures those three parts together. Cup-shaped recess 32 forms a seat for the end of sleeve 22. The seat optionally may have a low-friction insert including a self-lubricating (e.g., Teflon) washer 42, which abuts inner web 36, and a metallic (e.g., steel) washer 44, which is sandwiched between self-lubricating washer 42 and sleeve 22. Central body 26 optionally may be provided with one or more helical plates 42, which provide additional thrust when rotated to help advance the pier through the soil. The location of the bolt hole along elevation tube 28 is selected to properly position helical plate(s) 42 relative to the helical flights 14 on lead shaft 12.

Enhanced strength and durability of the pile, especially for seismically active locations, is afforded by selecting the proper grout formulation, by uniformly including certain reinforcing elements in the grout mix at a certain concentration, and by using a certain type of reinforced casing material, which increases bending resistance. The grout preferably is high performance, Portland cement based and shrinkage compensated. A preferred grout is PT Precision Grout, manufactured by King Packaged Materials Company, Burlington, Ontario, Canada. Another suitable grout is MASTERFLOW 1341, manufactured by BASF Construction Chemicals, LLC, Shakopee, Minn. The grout reinforcing elements preferably are round-shaft cold drawn steel wire fibers, preferably on the order of 0.7 mm in diameter and 30 mm long, and preferably having flat ends that anchor well within the grout mix. A suitable example is NOVOCON FE 0730 steel fibers, manufactured by SI Concrete Systems, Chattanooga, Tenn., which conform to ASTM A820/A820M Type 1. The preferred grout mix contains about 1.00% of steel fibers by volume. The casing material (sleeve) is a fiber reinforced polymer (FRP), preferably constructed on continuous glass fibers wound in a matrix of aromatic amine cured epoxy resin in a dual angle pattern that takes optimum advantage of the tensile strength of the filaments. A suitable example is BONDSTRAND 3000A fiberglass pipe manufactured by Ameron International Fiberglass Pipe Group, Burkburnett, Tex., in accordance with ASTM 02996 Specification for RTRP. Such a pipe sized for use in helical piles would have a wall thickness on the order of about 2.0 to 3.0 mm. Greater bending resistance would be afforded by using custom-manufactured pipe as the casing.

Testing of sample piles that combined FRP sleeves with the specified steel fiber reinforced grout as described in the preceding paragraph demonstrated assured integrity of the pile system during and after cyclic loading, allowing the pile system to sustain its axial capacity. See Y. Abdelghany and M. El Naggar, "Full-Scale Experimental and Numerical Analysis of Instrumented Helical Screw Piles Under Axial and Lateral Monotonic and Cyclic Loadings—A Promising Solution for Seismic Retrofitting," presented Jun. 28, 2010 at the Sixth International Engineering and Construction Conference in Cairo, Egypt (incorporated by reference herein in its entirety). This testing demonstrated the above-described pile system as appropriate for highly seismic areas as it will maintain serviceability after severe lateral loading events.

Figure 3:
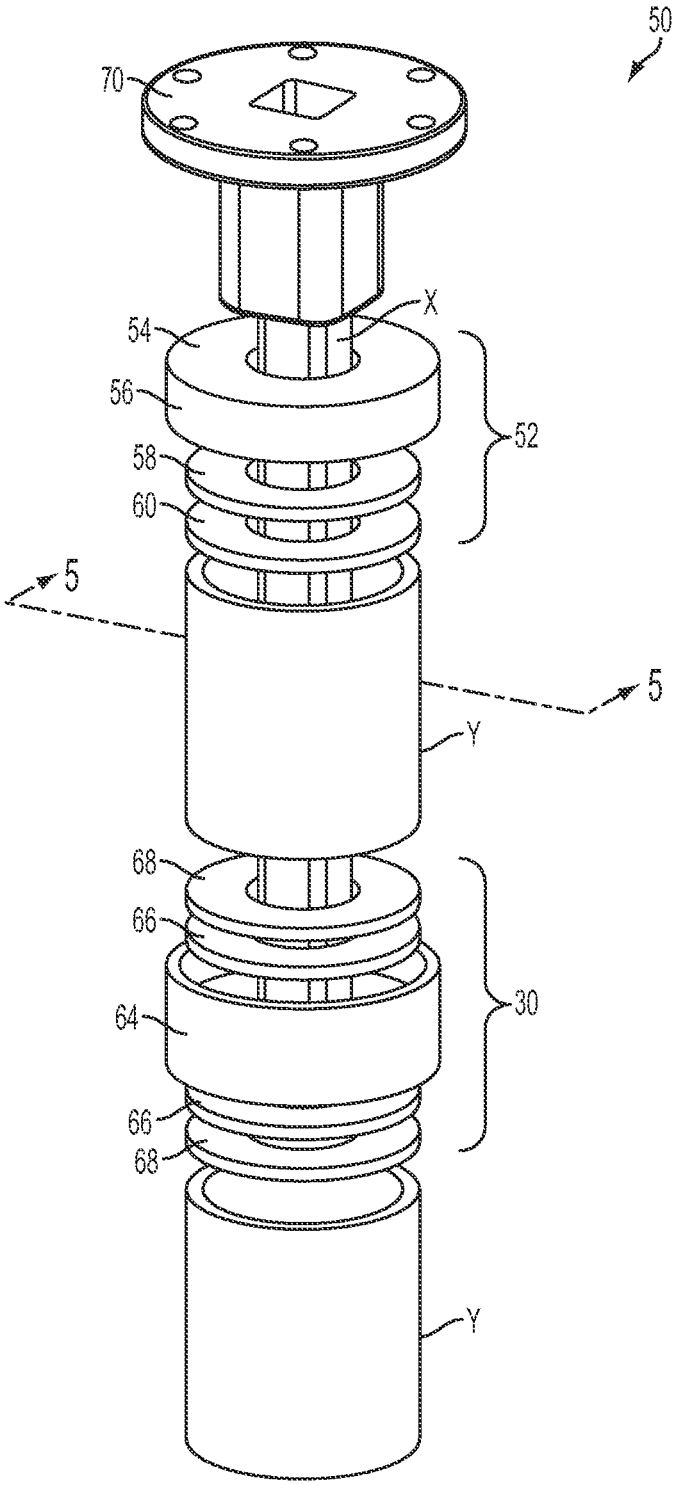
FIG. 3 is an exploded perspective view of a driving assembly usable to install the pile of FIG. 1.
Figure 4:
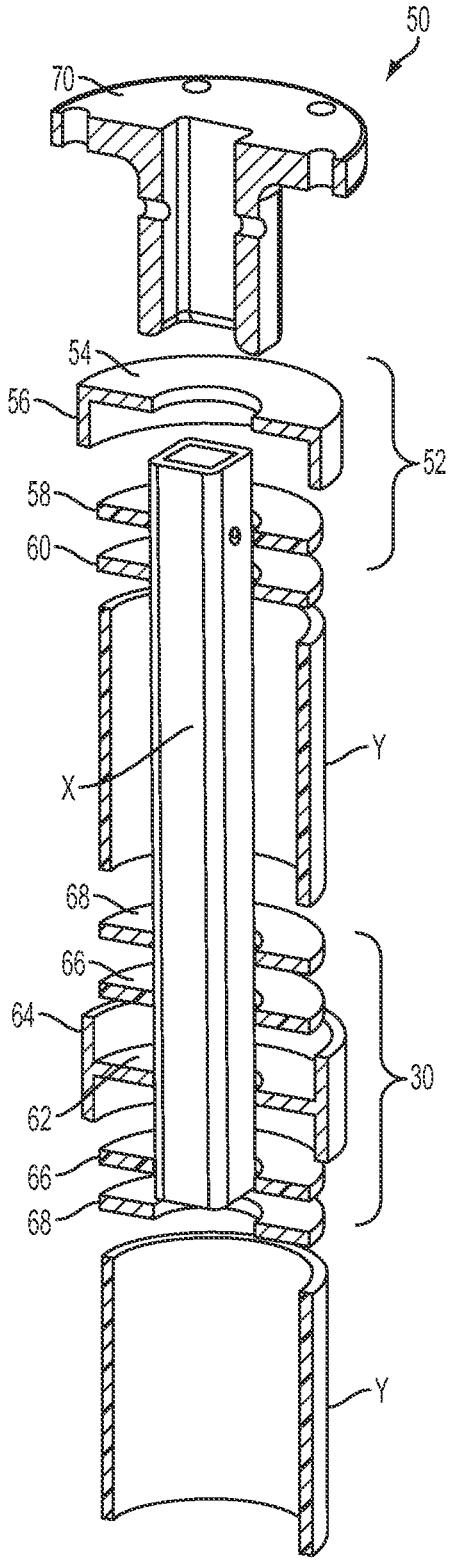
FIG. 4 is an exploded perspective view in longitudinal section of the driving assembly of FIG. 3.
Figure 5:
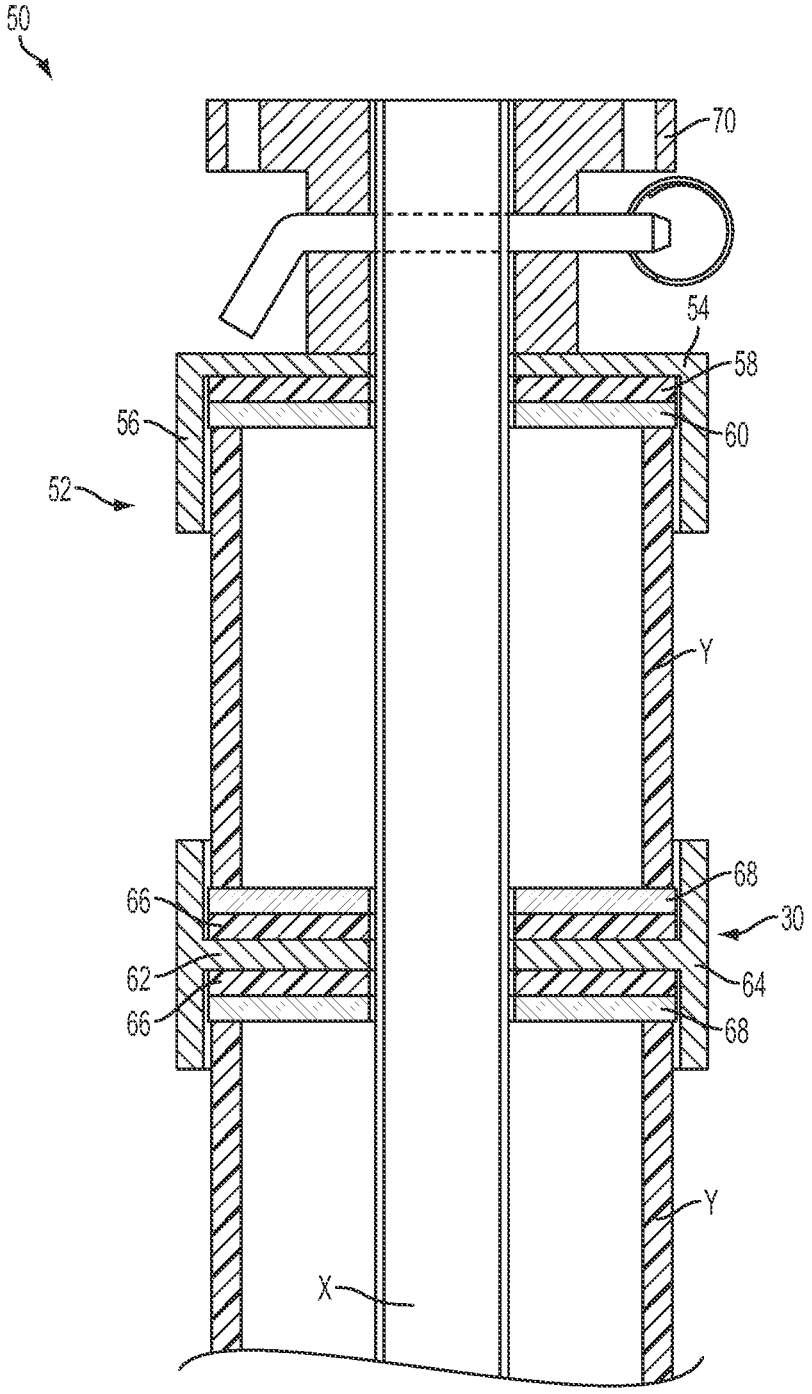
FIG. 5 is a longitudinal sectional view of the assembled driving assembly taken along line 5-5 in FIG. 3.

A pile driving assembly, usable to install a pile, will now be described with reference to FIGS. 3-5. Driving assembly 50 is shown interfaced with a generic pier shaft section X and generic sleeve sections Y, which are the particular shaft and sleeve sections being driven at any given state of pile installation. The same pertains to sleeve coupling and centralizer 30. A driving cap 52 has an annular end wall 54 and a depending annular side wall 56. An annular low-friction drive seat is formed in driving cap 52 by a self-lubricating (e.g., Teflon) washer 58, which abuts end wall 54, and a metallic (e.g., steel) washer 60, which is sandwiched between self-lubricating washer 52 and an end of upper sleeve section Y. The upper sleeve section Y may optionally be a short length of sleeve material or other pipe repeatedly used as a tool as successive shafts and sleeve sections are installed. Sleeve coupling 30 essentially resembles two driving caps 52 placed back-to-back, except that there is only a single annular central wall 62 that divides the coupling into two oppositely facing recesses bounded by annular side wall 64. Each recess has an annular low-friction drive seat similarly formed by a self-lubricating (e.g., Teflon) washer 66, which abuts central wall 62, and a metallic (e.g., steel) washer 68, which is sandwiched between self-lubricating washer 66 and an end of the adjacent sleeve section Y. A conventional square drive shaft tool 70, shown pinned to shaft X in FIG. 5, is adapted to be coupled to a conventional rotary tool head (not shown).

Pile installation using the above driving assembly proceeds as follows. Lead shaft section 12 is screwed almost completely into the soil by a rotary tool head coupled to drive shaft tool 70. (Alternatively, initial soil penetration can be done with lead screw 12, soil displacement coupling 20 and sleeve 22 preassembled as shown in FIG. 1.) Tool 70 is then uncoupled, and first extension shaft 16 and soil displacing coupling 20 are bolted at 40 to the protruding upper end of lead shaft 12. A sleeve section 22 is then placed around extension shaft 16 and seated in cup-shaped recess 32 of the soil displacing coupling. (Sleeve section 22 should be short enough so as not to hamper connection of the next extension shaft 18.) Driving cap 52 is then placed over the upper end of sleeve section 22 and tool 70 is connected to shaft extension 16 and rotated to advance the pier and the sleeve into the soil as the soil displacing coupling creates a cylindrical void in its wake. Tool 70 is then uncoupled and the next extension shaft 18 is coupled to the upper end of the first extension shaft 16. A sleeve coupling 30 is then placed over the upper end of sleeve 22 followed by extension sleeve 24, which is seated in the opposite side of coupling 30. Driving cap 52 is then placed over the upper end of sleeve section 24 and tool 70 is connected to shaft extension 18 and rotated to advance the assembly into the soil. The process is repeated with subsequent shaft extensions, sleeves and sleeve couplings until a competent load-bearing stratum is reached. Grout is poured or pumped into the casing, preferably after all the sleeves are installed. Alternatively, the grout may be placed in the casing in batches: one batch after each sleeve section is installed.

Whenever a sleeve section is placed in an annular low-friction seat, the seat interfaces preferably are lubricated with grease or other suitable lubricant to enhance the slipperiness of the interfaces. The low-friction characteristics of the annular seats may be provided by arrangements other than Teflon and steel washers, such as roller thrust bearings. The ability of the driving cap 52 and the sleeve couplings 30 to substantially freely rotate relative to the sleeve sections during pile installation advantageously enables the sleeve sections to be drawn into the soil by the lead screw (and pushed by the drive head, if necessary) substantially without rotation of the sleeve sections. This avoids the otherwise high frictional forces generated by constant rotational sleeve contact with the surrounding soil, reducing the amount of torque and energy needed for shaft rotation and minimizing abrasion of the sleeve.

While preferred embodiments have been described and illustrated above, it will be understood by those skilled in the art that various changes and modifications may be made without departing from the scope as defined by the appended claims.

We claim:

1. A cased helical pile installed in soil, comprising:

a segmented shaft having a screw near a lower end thereof;

a radially outwardly projecting soil displacing member on the shaft near the screw;

a segmented casing including a plurality of serially arranged, cylindrical sleeves surrounding the shaft, the lowest one of the sleeves disposed adjacent the soil displacing member; and at least one cylindrical sleeve coupling, each sleeve coupling surrounding the shaft and joining a pair of adjacent sleeves, each sleeve coupling including two axially opposed, annular coupling seats, each of the coupling seats abutting an end of one of the pair of adjacent sleeves, and wherein each sleeve coupling includes a center wall dividing the sleeve coupling into two oppositely facing recesses, each recess bounded by an annular outer side wall and forming the coupling seats, and wherein each of the annular coupling seats includes a self-lubricating washer abutting the center wall and a metallic washer abutting the self-lubricating washer and abutting an end of one of the sleeves.

2. The cased helical pile according to claim 1, wherein each of the self-lubricating washers is made of Teflon, and each of the metallic washers is made of steel.

3. The cased helical pile according to claim 1, further comprising grout substantially filling the interior of the casing and encasing the shaft, and wherein the grout is reinforced with steel fibers mixed into the grout.

4. The cased helical pile according to claim 3, wherein all of the sleeves are made of a fiber-reinforced polymer.

5. The cased helical pile according to claim 4, wherein the fiber-reinforced polymer includes continuous glass fibers wound in a matrix of aromatic amine cured by epoxy resin in a dual angle pattern.

6. The cased helical pile according to claim 3, wherein the grout is a Portland cement based and shrinkage compensated grout, and wherein the steel fibers account for about 1% of the grout mix by weight and are about 0.7 mm in diameter and about 30 mm long.

7. The cased helical pile according to claim 1, wherein the soil displacing member has a bottom seat facing axially away from the screw and abutting an end of the lowest one of the sleeves.

8. The cased helical pile according to claim 1, wherein each of the self-lubricating washers is made of Teflon.

9. The cased helical pile according to claim 1, wherein each of the metallic washers is made of steel.

10. The cased helical pile according to claim 1, wherein each sleeve coupling has an opening receiving the shaft.

11. The cased helical pile according to claim 1, wherein each of the sleeve couplings is rotatable relative to the sleeves.

* * * * *